United States Patent [19]

Horak

[11] 4,093,061

[45] June 6, 1978

[54] DISC INK RIBBON

[75] Inventor: Anthony Horak, Detroit, Mich.

[73] Assignee: Burroughs Corporation, Detroit, Mich.

[21] Appl. No.: 771,341

[22] Filed: Feb. 23, 1977

[51] Int. Cl.[2] ..... B41J 31/14; B41J 27/04

[52] U.S. Cl. ..... 400/194; 400/202

[58] Field of Search ..... 101/336; 197/1 R, 150, 197/151, 168, 171, 172

[56] References Cited

U.S. PATENT DOCUMENTS

| | | | |
|---|---|---|---|
| 381,910 | 5/1888 | Crandall | 197/150 |
| 2,506,255 | 5/1950 | von Kraemer | 197/150 |
| 3,340,982 | 9/1967 | Torley et al. | 197/1 R |
| 3,460,665 | 8/1969 | Dodsworth et al. | 197/171 |
| 3,707,214 | 12/1972 | Ponzano | 197/53 |
| 3,844,395 | 10/1974 | Mero et al. | 197/1 R |

OTHER PUBLICATIONS

*IBM Tech. Disc. Bulletin,* R. L. Cowardin et al., vol, 13, No. 8, Jan., 1971, p. 2465.

*Primary Examiner*—Paul T. Sewell

*Attorney, Agent, or Firm*—Robert J. Gaybrick; Edward J. Feeney, Jr.; Kevin R. Peterson

[57] ABSTRACT

A rotable circular disc ribbon for use with a high speed impact printer. The disc ribbon includes a central ink storage chamber enclosing ink saturated porous material. The disc ribbon also includes an outer circumferential film portion positionable between the character dies or dot matrix pins of an impact printer and an image receiving web. Capillary action between ink storage chamber and the film portion of the ribbon provides continual replenishment of the ink in the film portion as it is depleted by impact printing on the web. This replenishment is further aided by centrifugal forces propelling the ink from the storage chamber to the film portion in amounts which are related to the speed of rotation of the ribbon disc.

5 Claims, 4 Drawing Figures

DISC INK RIBBON

BACKGROUND OF THE INVENTION

1. Field of the Invention

This invention relates generally to ink ribbons for impact printers, and particularly to a circular ink ribbon or ribbon disc with a central ink supply chamber for continuously resupplying the impact portion of the ribbon with ink by capillary action from the ink supply chamber to the film portion and by centrifugal forces acting on the ink as the ribbon disc is rotated during printing operations.

2. The Prior Art

Previous ink ribbons have generally been of two types, the first type being single use ribbons which contain only the ink trapped in the ribbon film during manufacture and which are intended to be discarded after a predetermined amount of use, and the second type being replenishable ink ribbons wherein the ribbon film is either continuously or intermittently recoated with ink prior to or during printing operations. Respective examples of these two types of disc ink ribbons are disclosed in U.S. Pat. No. 575,145 and U.S. Pat. No. 2,506,255. A shortcoming of the discardable ribbons is that print quality may be significantly degraded by the exhaustion of ink in the ribbon at a time well in advance of deterioration of the ribbon film. The normal procedure at this point is to discard the ribbon and replace it with a brand new ribbon. In an attempt to economize, devices have been known which include an ink storage receptacle and an ink applicator device to apply ink either continuously or intermittently to the ribbon film in an attempt to maintain a constant print quality. These devices have reached a high level of sophistication but have been confined primarily to the area of elongated web spooled ribbons. With this sophistication, however, there has arisen an equal increase in the complexity of the ribbon structure and in their cost and flexability in printer design is impeded by the required use of elongated web spooled ribbons.

SUMMARY OF THE INVENTION

It is an object of this invention to provide an economical ribbon disc for use with an impact printer.

It is another object of this invention to provide a ribbon disc with a printing portion which may be continually replenished with ink.

It is a further object of this invention to provide a rotatable ribbon disc with a peripheral printing portion which is resupplied with ink from a central ink storage portion by centrifugal forces acting on the stored ink during rotation of the ribbon disc.

It is a related object of this invention to provide a rotatable ink replenishable ribbon disc wherein the printing portion of the ribbon is supplied with ink from an ink storage portion by capillary action and by centrifugal forces acting upon the stored ink during rotation of the ribbon disc.

It is a further object of this invention to provide a rotatable ribbon disc with a printing portion which is replenished with ink in an amount related to printing speed.

In accordance with the present invention a rotatable circular ribbon disc is provided with a circumferential inked film band on its periphery interposed between the character forming dies or pins of an impact printer and a print receiving medium to supply ink for forming visible character images on the medium upon impact of the dies or pins against the ribbon disc and print medium. The traverse of the print head across the print receiving medium results in the rotation of the ribbon disc. The ribbon disc includes in its central portion an ink storage chamber enclosing ink saturated porous material. The porous material includes small channels or capillaries which communicate with the film portion of the ribbon disc and provide continual ink replenishment of the film portion. The disc ribbon is designed so that its rotation during printing initiates centrifugal forces which act upon the ink to enhance the capillary action in a manner proportional to the speed of rotation which is in turn proportional to the printing rate.

DETAILED DESCRIPTION OF THE INVENTION

Figure 1:
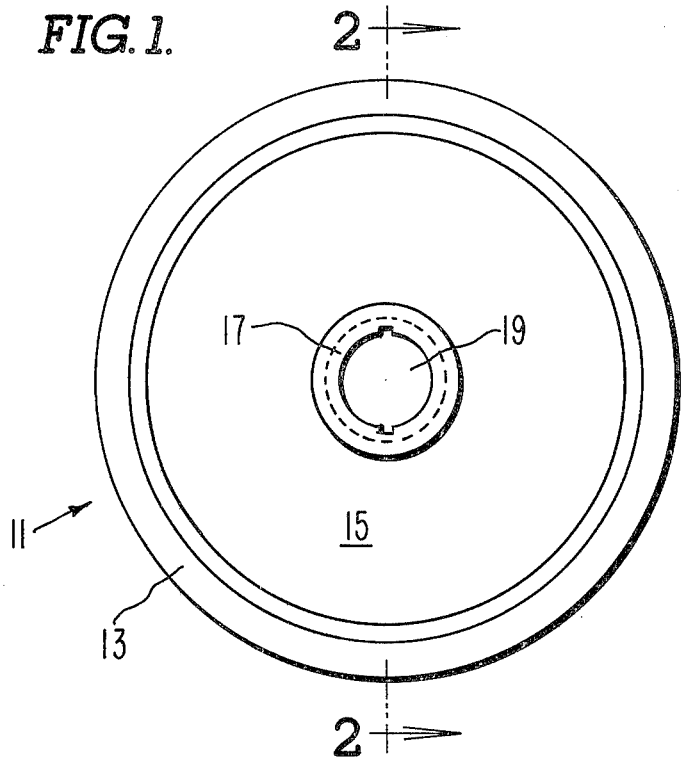
FIG. 1 is a frontal view of the disc ribbon of the present invention.

The apparatus shown in FIG. 1 includes all the basic elements of the ribbon disc of the present invention The ribbon disc 11 has a circumferential ribbon film 13 forming a band on the periphery of the ribbon disc. A concentric ink storage chamber 15 is located at a reduced radius on the ribbon disc 11. Within the ink storage chamber 15 is a hub member 17 and an axle receiving aperture 19 to facilitate mounting of the ribbon disc on a suitable rotatable axle for rotation therewith.

Figure 2A:
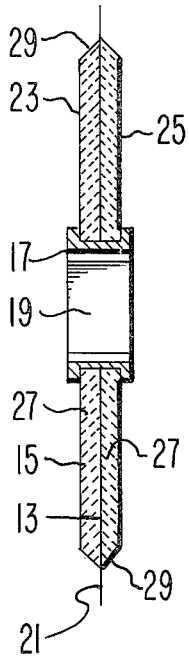
FIG. 2*a* is a cross sectional view of the disc ribbon of FIG. 1 taken along the lines 2—2.

In FIG. 2*a* it can be seen that the ribbon film 13 extends completely through the ink storage chamber 15 and presents a printing portion 21 exterior of the ink storage chamber 15. The ink storage chamber 15 comprises left and right casing members 23 and 25, respectively, of a suitable ink impermeable material such as Mylar. A relatively porous plastic material 27 is encased within the left and right halves 23 and 25 of the ink storage chamber 15. The porous material 27 is selected such that ink of the particular viscosity used to replenish the ribbon disc 13 is capable of capillary migration toward the portion of the ribbon film 13 encased within the ink storage chamber 15 through minute channels in the porous material 27. The ribbon film 13 is of suitable material to withstand the impact of character dies or matrix pins without structural deterioration and, also, to redistribute ink supplied by the porous material 27 to the portions of the ribbon film outside of the storage chamber 15, i.e. printing portion 21. An example of suitable ink porous material 27 is fibrous nylon. During the manufacture of the disc 11 the porous material 27 is saturated with ink prior to sealing the left and right halves 23 and 25 of the ink storage chamber 15. Alternately, the storage chamber 15 could be made readily openable for periodic refilling with ink.

Figure 2B:
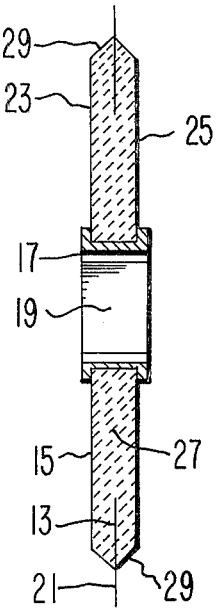
FIG. 2*b* is a cross section of an alternate embodiment of the disc ribbon of FIG. 1 taken along lines 2—2.

In the alternate embodiment of FIG. 2*b* it can be seen that the film portion of the ribbon 13 extends only partially into the ink storage chamber 15 but has a substantial portion surrounded by the ink saturated porous material 27.

In the operation of a printing device with the disc ribbon of the instant invention it is contemplated that the disc ribbon is mounted on a suitable rotatable axle for rotation therewith. The speed of rotation of the axle would most desirously be proportional to the printing speed such that the higher the printing speed the higher the RPM of the ribbon disc 11. It can be seen that rotation of the ribbon disc 11 about its central axis will impart centrifugal forces to the ink within the storage chamber 15 toward the tapered portions 29 of the chamber 15. This centrifugal feeding is in addition to the capillary supply of ink through minute channels in the porous material 27. The centrifugal fources acting upon the ink during rotation of the disc 11 results in an increased accumulation of ink at the tapered portions 29 of the ink supply chamber 15. The ink accumulated at the tapered portions 29 further migrates through the ribbon film 13 to replenish with ink the printing portion 21 of the ribbon film 13. Since the depletion of ink from the printing portion 21 is directly related to the number of characters printed in a given time period, i.e. the print rate of the printer and since the rate of rotation of the ribbon disc 11 can similarly be related to the printing rate, the instant invention by relying on capillary and centrifugal ink feeding replenishes the printing portion 21 with ink in an amount which is related to ink depletion from the printing portion 21.

Figure 3:
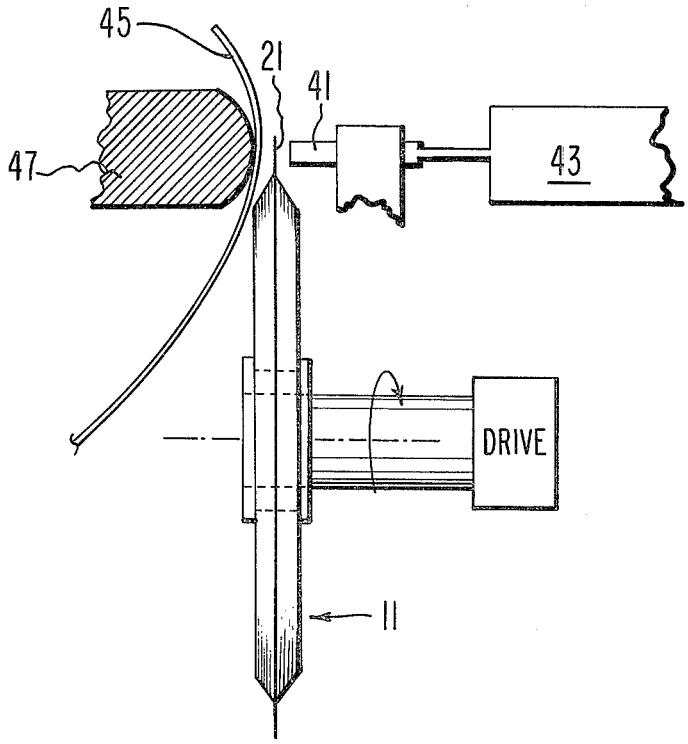
FIG. 3 is an exemplary view of the disc ribbon of the present invention in juxtaposition to the character dies, image receiving web and platen of an impact printer.

Turning attention to the FIG. 3, the ribbon disc 11 is shown in proper relation to the printing die 41, die actuating solenoid 43, image receiving web 45 and the backing platen 47. It can be seen that only the portion 21 of ribbon film is positioned for contact by the character die 41 and that rotation of the disc ribbon 11 will continuously reposition ink replenished portions of the ribbon film 13 in front of the character die 41.

While principles of the invention have now been made clear in two illustrated embodiments, it will be immediately obvious to those skilled in the art that modifications of structural materials which can be made without departing from the principles set forth. The appended claims are, therefore, intended to cover and embrace any such modifications within the limits only of the true spirit and scope of the invention.

What is claimed is:

1. A rotatable integral ribbon disc for use with a dot matrix or solid character impact printer comprising:

a circular ribbon film;

an ink supply housing concentric at a reduced diameter with said circular ribbon film, said housing having first and second complementary members disposed on opposite sides of said ribbon film for forming an ink supply chamber fully enclosing a portion of said ribbon film; and porous ink storage means within said ink supply chamber and surrounding said enclosed portion of the ribbon film for centrifugally replenishing the portion of the ribbon film outside of said housing with ink through said enclosed portion upon rotation of said ribbon disc.

2. The rotatable ribbon disc of claim 1 wherein said porous ink storage means comprises an ink saturated fibrous nylon material and said ink supply housing has a tapered portion at its outer periphery for directing ink toward said enclosed portion of ribbon film.

3. The rotatable ribbon disc of claim 2 further including:

a hub extending through the central portion of said ribbon disc;

a rotatable axle attached to said hub for rotation therewith; and means for rotating said axle at a speed directly proportional to the printing speed of said impact printer.

4. The rotatable ribbon disc of claim 2 wherein said fibrous nylon material includes a plurality of channels for the capillary migration of ink from said fibrous nylon material to said ribbon film, said capillary migration of ink being enhanced by rotation of said ribbon disc.

5. In an impact printing apparatus having character dies, solenoids for actuating the character dies, a print receiving medium and a backing platen, a rotatable ribbon disc comprising:

a circular ribbon film having a printing portion disposed between said character dies and said print receiving medium and a replenishing portion;

an ink supply housing concentric with said circular ribbon film and extending radially to enclose said replenishing portion of said ribbon film, said housing having a tapered portion for directing ink toward said replenishing portion; and inked porous ink storage material within said ink supply housing and surrounding said replenishing portion of said ribbon film for the capillary supply of ink to said replenishing portion, said capillary supply enhanced by centrifugal force acting upon said ink upon rotation of said ribbon disc whereby ink depleted from said printing portion by the impact of said character dies against said printing portion and said print receiving medium is resupplied from said replenishing portion by said capillary and centrifugal supply.

* * * * *